United States Patent [19]

Remaley et al.

[11] 4,045,599

[45] Aug. 30, 1977

[54] LOW TEMPERATURE SEALING OF ANODIZED ALUMINUM

[75] Inventors: Edward G. Remaley, New Kensington; Robert W. Baker, Natrona Heights; Raymond J. Meyer, Apollo, all of Pa.

[73] Assignee: Aluminum Company of America, Pittsburgh, Pa.

[21] Appl. No.: 649,403

[22] Filed: Jan. 15, 1976

[51] Int. Cl.[2] ..... C25D 11/24

[52] U.S. Cl. ..... 427/333; 427/419 A; 204/35 N; 204/38 A; 148/6.27; 148/6.24; 134/41; 156/667

[58] Field of Search ..... 427/333, 419 A; 204/35 R, 35 N, 38 S, 33, 38 A; 156/22, 667; 148/6.27, 6.24; 134/41

[56] References Cited

U.S. PATENT DOCUMENTS

| | | | |
|---|---|---|---|
| 3,152,970 | 10/1964 | Jensen | 204/35 N |
| 3,365,377 | 1/1968 | Michelsen | 204/35 N |
| 3,791,940 | 2/1974 | Alexander | 204/35 N |
| 3,822,156 | 7/1975 | Wallace | 156/22 |
| 3,897,287 | 7/1975 | Meyer et al. | 204/35 N |

*Primary Examiner*—Ralph S. Kendall
*Attorney, Agent, or Firm*—Andrew Alexander

[57] ABSTRACT

A method of forming a low temperature seal on anodized aluminum and removing sealing smudge therefrom comprises treating anodized aluminum with an aqueous sealing solution at a temperature of at least 140° F and containing 2 to 6 g/l of hydrolyzable metallic salt, 5 to 20 ml/l of an ethanolamine and 50 to 2000 mg/l soluble sulfate ($SO_4$=), and thereafter removing sealing smudge formed by this treatment with mineral acid.

8 Claims, 1 Drawing Figure

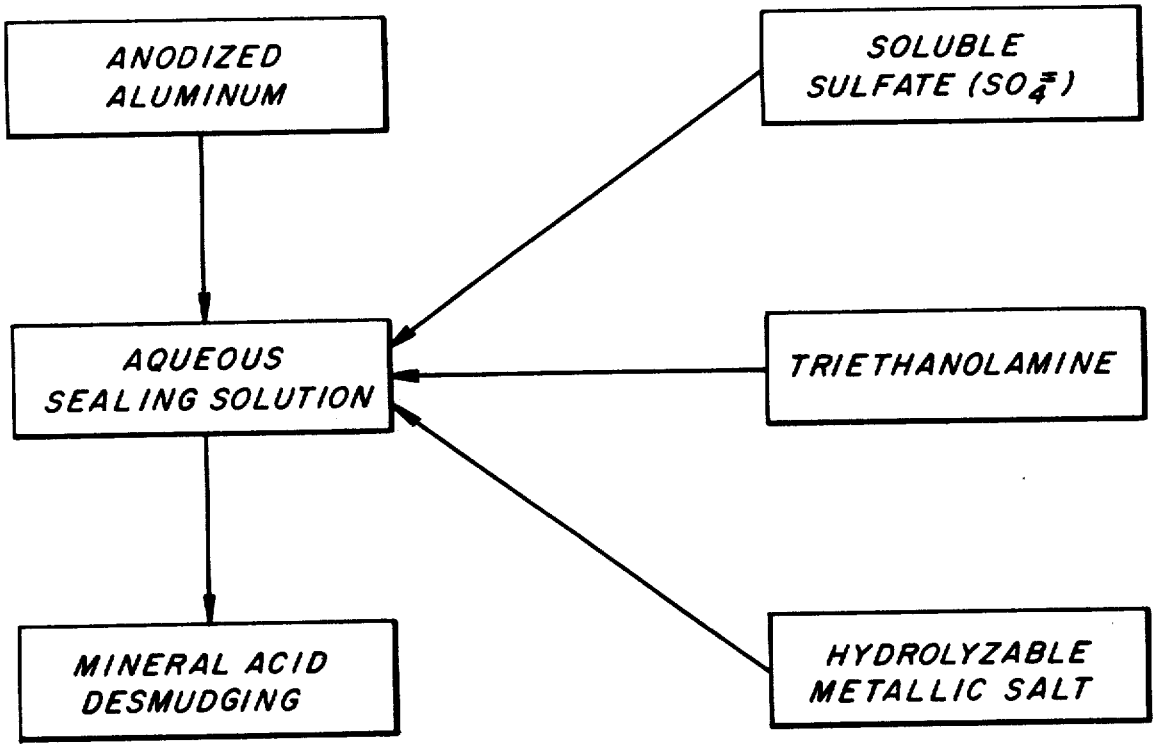
ANODIZED ALUMINUM
SOLUBLE SULFATE ($SO_4^{=}$)
AQUEOUS SEALING SOLUTION
TRIETHANOLAMINE
MINERAL ACID DESMUDGING
HYDROLYZABLE METALLIC SALT

LOW TEMPERATURE SEALING OF ANODIZED ALUMINUM

BACKGROUND OF THE INVENTION

This invention relates to anodized aluminum and more particularly to a method of providing a low temperature, smudge free seal on anodized aluminum.

Because of the need to conserve energy resources, considerable effort has been expended in finding new methods for sealing anodized aluminum in ways which would reduce the energy requirement necessary for such sealing.

Anodized aluminum is usually sealed to render it impervious to elements which could adversely affect the aluminum substrate, because, in many instances, especially in architectural applications, it will be exposed to the atmosphere for many years. It is therefore imperative that the seal be of very high quality to ensure satisfactory weatherability.

High quality seal as used herein, is defined as a sealed, smudge-free anodized aluminum, which, after being treated with a standard chromic/phosphoric acid solution known to those skilled in the art as the "acid dissolution test," has a weight loss of not more than 2 mg/in$^2$.

In the prior art, in order to effect a satisfactory seal on anodized aluminum, it was necessary to maintain the sealing solution at or near the boiling point. This high temperature was necessary to provide a high quality seal such that subsequent subjection of the sealed anodized aluminum to a mineral acid treatment to remove sealing smudge provided a smudge-free, sealed anodized surface. For example, Alexander U.S. Pat. No. 3,791,940 teaches sealing undyed anodized aluminum in aqueous hydrolyzable metallic salt at about 212° F or boiling. Alternatively, Wallace U.S. Pat. No. 3,822,156 discloses sealing anodized aluminum in a solution of triethanolamine in hot water, with a preferred temperature being in the range of 175° F to about 212° F with optimum being near the boiling range of the solution. In both patents, it is taught that the sealed anodized aluminum is thereafter desmudged with mineral acid. Meter et al. U.S. Pat. No. 3,897,287 discloses the addition of a controlled amount of a soluble sulfate ($SO_4^=$) to a hydrolyzable salt such as disclosed and claimed in the aforesaid Alexander patent to provide a smoother sealing smudge which is lesser in quantity and is easier to remove in the subsequent mineral acid treatment. Again, it is suggested that the sealing bath temperature should be hot with a temperature range of 195° to 212° F being preferred. This process for sealing and subsequently removing sealing smudge with mineral acid has found widespread acceptance in the anodizing industry particularly for architectural applications.

As previously stated, the anodized surface must be properly sealed. To obtain such a seal, it can be seen from the prior art (such as that referred to above) that it was thought that a hot sealing bath, preferably at or near the boiling point of the sealing bath, was essential, especially when the sealed surface was subsequently subjected to a mineral acid treatment to remove smudge formed during sealing.

Quite surprisingly, we have discovered a method for sealing anodized aluminum at a lower temperature wherein sealing smudge formed thereby can still be advantageously removed with mineral acid without interfering with the quality of the seal.

SUMMARY OF THE INVENTION

A principal objective of this invention is to provide a lower temperature seal for anodized aluminum.

Another objective of this invention is to provide an improved method of sealing anodized aluminum at a lower temperature, wherein the sealing smudge is removable therefrom with mineral acid.

These and other objectives will become apparent from the description and drawing.

In accordance with these objectives, it has now been discovered that anodized aluminum can be sealed at a lower temperature and the smudge formed during sealing removed with mineral acid. The sealing comprises treating anodized aluminum with an aqueous sealing solution containing 2 to 6 g/l of a hydrolyzable metallic salt, 5 to 20 ml/l of an ethanolamine and 50 to 2000 mg/l soluble sulfate ($SO_4^=$), at a temperature of at least 140° F to provide the seal.

BRIEF DESCRIPTION OF THE DRAWING

In the description below, reference is made to the sole FIGURE which is a schematic diagram illustrating the steps and composition of the sealing solution in accordance with the invention.

DETAILED DESCRIPTION OF THE PREFERRED EMBODIMENTS

Anodized aluminum which can be sealed according to the invention may be anodized by any conventional method. For example, it may be anodized by using a sulfuric acid electrolyte as is well known to those skilled in the art or by using a sulfophthalic acid/sulfuric acid electrolyte such as described and claimed in Kampert U.S. Pat. No. 3,227,639.

By reference to the drawing, it will be seen that anodized aluminum can be sealed at a low temperature in an aqueous sealing solution containing a hydrolyzable metallic salt, an ethanolamine and soluble sulfate ($SO_4^=$). Thereafter, sealing smudge formed can be removed by a mineral acid treatment.

The temperature of the sealing solution should not be less than 140° F and preferably at least 150° F. Further preferably, the temperature of the sealing solution need not be greater than 170° F, although the solution can be useful to its boiling point but obviously this can minimize its energy saving benefits. A suitable temperature is in the range of 150° to 170° F.

A hydrolyzable metallic salt which can be suitable for use in the present invention may be selected from the group consisting of nickel acetate, cobalt acetate and nickel sulfate. Also, hydrolyzable salts of aluminum, zinc, copper and lead and the like can sometimes be useful. Nickel acetate and nickel sulfate are preferred. The concentration of these salts in the sealing solution can range from 2 to 8 g/l with a preferred range being 3 to 6 g/l.

Preferably, the ethanolamine used in the present invention is triethanolamine; however, mono- or diethanolamine of a combination thereof can be quite suitable. The amount of triethanolamine in the sealing solution can range from 5 to 20 ml/l with a range of 8 to 12 ml/l being preferred. Because triethanolamine has the capability to form complex compounds, the amount of it present in the sealing solution is important, as explained hereinafter, particularly with respect to the amount of hydrolyzable metallic salt present.

With respect to soluble sulfate ($SO_4^=$) in the sealing solution, its concentration can range from about 50 to 2000 mg/l with a preferred range being from 1000 to 1500 mg/l. Any soluble sulfate ($SO_4^=$) source may be used; however, a highly suitable source is sulfuric acid ($H_2SO_4$). When nickel sulfate is used, it also can supply the sulfate ($SO_4^=$). By soluble sulfate is meant an inorganic, ionic substance which will produce divalent sulfate ion ($SO_4^=$) in an aqueous media.

Since minor amounts of contaminants can work to adversely affect the quality of the seal, it is preferred that the aqueous media in which the above ingredients are dispersed is deionized or distilled water. Also, the aqueous media and the above ingredients should be combined to form a sealing solution having a pH in a range of 6.5 to 7.5, and preferably within 6.8 to 7.2

It is important that the sealing solution of the present invention be maintained within the above-mentioned temperature and concentration ranges in order that a good quality seal be obtained and that the smudge be removable with mineral acid. For instance, if the soluble sulfate ($SO_4^=$) content goes substantially beyond 2000 mg/l, sealing smudge formed is still removable with a mineral acid treatment but the quality of seal can deteriorate. Similarly, if the hydrolyzable metal salt concentration decreases substantially below the lower limit, the quality of seal obtained may remain satisfactory but the sealing smudge formed can be difficult to remove with mineral acid.

With respect to the hydrolyzable metallic salt and triethanolamine, their proportions in the sealing solution are important. While the inventors do not necessarily wish to be bound by any theory, they believe there may be a synergistic effect resulting from the combination of nickel acetate and triethanolamine. This effect appears to involve the formation of a nickel-amine complex which results from combining nickel acetate, for example, and triethanolamine in the same sealing solution. This complex may be responsible in part for the ability to obtain a high quality seal at lower temperatures. Thus, a nickel acetate to triethanolamine ratio by weight should be at least 0.18 and preferably at least 0.27.

As well as providing a low temperature seal for anodized aluminum, the combination of the hydrolyzable salt, such as, for example, nickel acetate and triethanolamine have another advantage which may be attributed to the aforementioned complex. It is believed that the nickel in the sealing solution is not lost by precipitation to the extent lost in conventional or prior art sealing methods using hydrolyzable salt as referred to earlier. Accordingly, the present invention can result in a considerable savings in the cost of nickel acetate.

Another important aspect of the present invention resides in the order in which the ingredients are added to the deionized or distilled water. It is preferred that the soluble sulfate ($SO_4^=$) be added before the other constituents and thereafter, either the hydrolyzable metallic salt or the triethanolamine added. If either or both of the latter ingredients are added before the soluble sulfate ($SO_4^=$), the sealing solution has been found to be less effective in providing a high quality seal for reasons which are not completely understood.

Anodized aluminum can be sealed in the sealing solution of the present invention in a time period preferably not greater than 45 minutes, with a suitable seal being effected in a time period of 25 to 35 minutes. However, it should be understood that the seal time can be a period sufficient to provide a seal.

The present sealing system is considered to be unique in that its minimum temperature for sealing can vary with the type of anodic coating. The types of anodic coatings referred to are those providing integral color on aluminum upon anodization. More particularly, it has been discovered that integrally colored anodic coatings on aluminum, characterized by having colors ranging from very light to dark bronze, depending on the anodization conditions, can be treated by the sealing solution of the present invention to produce a high quality seal at a temperature in the range of 140° to 155° F. A bronze coating typical of those just referred to can be produced on Aluminum Association Alloy No. 1100 clad with the same alloy (Anoclad 11 sheet alloy) and anodized by conventional means in a sulfophthalic acid/sulfuric acid electrolyte as disclosed by the aforementioned Kampert patent. By comparison, anodic coatings ranging from natural (clear) to integrally colored light grey and light biege can require a temperature in the range of 160° to 170° F to produce a high quality seal, when using a sealing solution of the invention. A light grey coating typical of that referred to can be produced on Anoclad 11 by anodizing in the sulfuric acid electrolyte referred to earlier. Since the coat of energy required in sealing increases by about 15% for every 10° F increase in temperature of the sealing solution between 140° and 180° F and by about 22% for every 10° F above 180° F, selective color or process sealing, as noted, can be highly beneficial.

After an anodic oxide coating on aluminum has been sealed in accordance with this invention, sealing smudge formed thereon can be removed advantageously with a room temperature mineral acid treatment of a few seconds to a few minutes, thereby providing a smudge-free finish. Mineral acids which may be used include nitric and sulfuric and the like, with sulfuric being preferred.

The present invention is advantageous in that it contemplates a high quality seal on anodized aluminum at about half the cost of conventional or prior art seals, for example, as referred to hereinabove. This savings includes reduced thermal energy in bringing the solution to sealing temperature and maintaining it there. Also, because of the much lower operating temperature, the cost of replenishing the aqueous media with distilled or deionized water is reduced considerably. And, as noted earlier, the proposed nickel-amine complex is apparently a much more efficient means of using nickel acetate or the like in a sealing solution, since it does not permit substantial irreversible precipitation of the acetate from the solution as in the prior art. Thus, the amount of hydrolyzable metallic salt, e.g., nickel acetate, required over a period of time can be reduced considerably.

The following examples are further illustrative of the invention.

EXAMPLE 1

A specimen of a conventional Anoclad 11 sheet alloy (an Aluminum Association Alloy No. 1100 clad with the same alloy) was anodized using conventional practices to produce a light bronze colored oxide coating, thickness 0.7 mils, in a sulfophthalic acid/sulfuric acid electrolyte. The specimen was sealed for a period of 30 minutes in a sealing solution, pH of 6.9, temperature of 150° F, and containing 4 g/l nickel acetate, 5 ml/l triethanolamine and 50 mg/l soluble sulfate ($SO_4^=$). Smudge formed during sealing was removed by immersing the specimen in room temperature (75° F) sulfuric acid, 15 wt.%, for 3 minutes. In accordance with the acid dissolution test, quality of seal was then determined by immersing the specimen in chromic/phosphoric acid at a temperature of 100° F for 15 minutes. Weight loss was 0.34 mg/in² indicating a high quality seal.

EXAMPLE 2

A specimen of Anoclad 11 was anodized to a medium bronze color in a sulfophthalic acid/sulfuric acid electrolyte and sealed according to the conditions in Example 1, except the sealing solution contained 500 mg/l sulfate ($SO_4^=$). The oxide coating thickness was 1.0 mil. Sealing smudge was removed as in Example 1. A high quality seal was obtained. Weight loss in the acid dissolution test was 1.8 mg/in².

EXAMPLE 3

A specimen of Anoclad 11 was anodized and sealed as in Example 2 except triethanolamine was not used in the sealing solution. The quality of seal by weight loss in the acid dissolution test was 10.5 mg/in². Thus it can be seen that triethanolamine is required in the sealing solution in order that a high quality seal be obtained at these lower temperatures.

EXAMPLE 4

A specimen of Anoclad 11 sheet alloy was anodized in a 15 wt.% sulfuric acid electrolyte to produce a grey oxide coating, thickness 0.9 mils. The specimen was sealed for 30 minutes in a sealing solution at a pH of 6.9 and a temperature of 170° F and containing 4 g/l nickel acetate, 10 ml/l triethanolamine, and 1500 mg/l soluble sulfate ($SO_4^=$). The smudge formed during sealing was removed as in Example 1. The quality of seal by the acid dissolution test was 2.0 mg/in².

EXAMPLE 5

Two specimens of Anoclad 11 sheet alloy were anodized to a medium bronze color as in Example 2. A first specimen was sealed in the solution of Example 4 except the temperature was 150° F. A second specimen was sealed in the same solution except the nickel acetate concentration was increased to 6 gms/l. Sealing smudge was removed by the treatment in Example 1. Both specimens had a high quality seal as indicated by respective weight losses, 1.0 mg/in² and 1.6 mg/in², in the acid dissolution test.

Thus, it can be seen from these Examples that anodized aluminum can be provided with a high quality seal at relatively low temperatures in the sealing solution of this invention. Additionally, the sealing smudge formed on anodized aluminum sealed in accordance with this invention can be removed with a simple mineral acid treatment, thereby providing a smudge-free anodized surface without adversely affecting the quality of the seal.

While the invention has been described in terms of preferred embodiments, the claims appended hereto are intended to encompass all embodiments which fall within the spirit of the invention.

Having thus described our invention and certain embodiments thereof, we claim:

1. A method for forming a low temperature seal on anodized aluminum and removing sealing smudge therefrom comprising:

a. contacting said anodized aluminum with an aqueous sealing solution containing 2 to 6 g/l of hydrolyzable metallic salt, 5 to 20 ml/l of an ethanolamine, and 50 to 2000 mg/l soluble sulfate ($SO_4^=$), for a period of time sufficient to provide said seal, said solution being capable of providing a seal at a temperature of at least 140° F; and b. removing sealing smudge formed in said prior step with mineral acid.

2. The method according to claim 1 wherein the ethanolamine is triethanolamine.

3. The method according to claim 1 wherein the pH of sealing solution is in the range of 6.5 to 7.5.

4. The method according to claim 1 wherein the hydrolyzable metal salt is selected from the group consisting of nickel acetate, and nickel sulfate.

5. The method according to claim 4 wherein the hydrolyzable metallic salt is nickel acetate.

6. The method according to claim 1 wherein said aqueous solution comprises distilled or deionized water.

7. The method according to claim 2 wherein the weight ratio of hydrolyzable salt to triethanolamine is at least 0.18.

8. A method of forming a low temperature seal on anodized aluminum and removing sealing smudge therefrom comprising:

a. providing a sealing solution consisting essentially of water, 2 to 6 g/l hydrolyzable metallic salt selected from the group consisting of nickel acetate and nickel sulfate, 5 to 20 ml/l of triethanolamine, and 50 to 2000 mg/l soluble sulfate ($SO_4^=$), wherein said soluble sulfate ($SO_4^=$) is added to said water before said salt or said triethanolamine, b. treating said anodized aluminum in said sealing solution at a temperature in the range of 150° to 170° F for a time period not greater than 45 minutes to provide said seal, and c. removing sealing smudge formed in said treating step with mineral acid to provide smudge-free, anodized aluminum.

* * * * *